United States Patent [19]

Mailliet et al.

[11] Patent Number: 4,512,702

[45] Date of Patent: Apr. 23, 1985

[54] INSTALLATION FOR FEEDING A SHAFT FURNACE

[75] Inventors: Pierre Mailliet; Leon Ulveling, both of Howald, Luxembourg

[73] Assignee: Paul Wurth S.A., Luxembourg, Luxembourg

[21] Appl. No.: 473,965

[22] Filed: Mar. 10, 1983

[30] Foreign Application Priority Data

Mar. 10, 1982 [LU] Luxembourg ..... 84000

[51] Int. Cl.[3] ..... C21B 7/20

[52] U.S. Cl. ..... 414/202; 414/201; 414/205

[58] Field of Search ..... 414/199–206; 266/176, 184

[56] References Cited

U.S. PATENT DOCUMENTS

| | | | |
|---|---|---|---|
| 127,214 | 5/1872 | Bauman | 414/204 |
| 908,594 | 1/1909 | Mitchell | 414/206 |
| 2,667,278 | 1/1954 | Tesch et al. | 414/201 |
| 4,162,784 | 7/1979 | Legille et al. | 414/199 X |

FOREIGN PATENT DOCUMENTS

| | | |
|---|---|---|
| 64909 | 7/1972 | Belgium . |
| 72956 | 2/1976 | Belgium . |
| 82840 | 10/1980 | Belgium . |
| 12310 | 6/1980 | European Pat. Off. . |
| 1758479 | 2/1971 | Fed. Rep. of Germany . |

*Primary Examiner*—Robert G. Sheridan

*Attorney, Agent, or Firm*—Fishman & Dionne

[57] ABSTRACT

A feeding mechanism for a shaft furnace is presented wherein the feeding mechanism is mounted axially on the furnace and employs a vertically adjustable frusto-conical dosing element for vertical flow of charging material to a distributing spout.

24 Claims, 8 Drawing Figures

INSTALLATION FOR FEEDING A SHAFT FURNACE

BACKGROUND OF THE INVENTION

This invention relates to the field of feeding mechanisms for shaft furnaces. More particularly, this invention relates to a new and improved feeding device for shaft furnaces in which a vertical feed channel leading to a rotary or oscillating distributing spout is mounted on the head of the furnace on the vertical axis of the furnace.

In the prior art, the rate of material to be fed to the furnace, flowing from the storage enclosure to the spout, has been regulated by a dosing device, usually of the type described in French Pat. No. 73 07 717. This dosing device has been mounted in a slanting passage connecting the base of the storage enclosure to the vertical feed channel above the spout. This slanting passage has been the cause of many problems associated with the distribution of furnace charge material. These problems are discussed in detail in UK Patent application No. A-2085135.

Various attempts have been made to solve these problems such as, for example, providing guide blades as shown in the aforementioned UK Patent application No. A-2085135 or by providing a type of tubular plug as disclosed in French Pat. No. 76 20 742. All of these prior attempts are aimed at correcting the flow path and direction of the falling material to be fed to the furnace in order to ensure that it falls vertically and symmetrically onto the spout. Unfortunately, these attempts have not proved satisfactory nor are they capable of providing the improved results which could be expected if the storage enclosure and its flow orifice were situated on the vertical axis, thereby enabling the material fed to the furnace to fall vertically and centrally onto the spout.

In the past, a vertical axis feed mechanism was thought unattainable for two reasons. First, the majority of feeding or charging mechanisms in which a spout is employed comprise two juxtaposed storage enclosures operating alternatively, and it is not possible to position two such adjacent enclosures on the axis of the furnace. Second, the dosing devices in the prior art can only operate by the pentration of a flow moving in an oblique direction. Consequently, even if there is only one single storage enclosure, as shown in French Pat. No. 79 29 853, the storage enclosure has to be made eccentric in order to provide the inclined section required for the operating of the dosing device.

SUMMARY OF THE INVENTION

The above-discussed and other deficiencies of the prior art are overcome or significantly reduced by the present invention. In accordance with the present invention, a new feeding mechanism for a shaft furnace is provided wherein the storage enclosure is positioned on the vertical axis of the furnace and includes a new type of dosing device which enables this axial positioning to be achieved. Thus, the feeding mechanism of the present invention is capable of regulating the rate of flow of material falling vertically and centrally onto the spout.

In accordance with the present invention, the feeding mechanism includes a storage enclosure, of which the lower part takes the form of a funnel, mounted symmetrically around and positioned above the central axis of a vertical feed channel. A tight fitting dosing device, of a substantially circular cross section, is mounted symmetrically (in respect to the central axis) on a level planar with the point of intersection of the storage enclosure base and the vertical channel. The feeding mechanism of the present invention is connected to driving means enabling it to be moved vertically between a closed position in which the feeding mechanism is caused to rest or seat tightly against the base of the enclosure, and adjustable open positions in which the device is raised a variable distance from its seating, in order to define an annular discharge orifice of varying size, delimited by the external contour and the lower base edge of the storage enclosure.

In the preferred embodiment, the storage enclosure should be a chamber designed to be alternately pressurized and ventilated. The dosing device preferably is shaped as a frustoconical element directed downwardly whereby the size of the aforementioned annular orifice may vary progressively during vertical movement of the feeding mechanism.

In a first embodiment the feeding device is pear-shaped, with a widened upper portion and a frustoconical element directed downwards, the intermediate part between the frustoconical element and the upper section defining a shoulder designed to interact with the seating for closure purposes. The dosing device of the first embodiment is integral with a control bar penetrating axially through the stand-by hopper and the storage enclosure and externally operated by means of a suitable motor.

In a second embodiment of the invention, the dosing device consists of an upper bell, wherein the lower edge serves for closing and regulating the flow, and a lower bell, wherein the edge serves as a hermetic sealing device between the furnace and the chamber. The upper bell comprises a hollow axial passage traversed by the control bar of the lower bell and rests on a shoulder of the latter, by which it is raised and lowered.

The constructions of the present invention not only enable the descending flow of material to be centralized but also eliminate the necessity of the slanting passage hitherto required between the storage chamber or chambers and the vertical feed channel. The elimination of this slanting passage enables the cost of investment and repair to be reduced, as well as reducing the height from which the charge has to fall.

The above-discussed and other advantages of the present invention will be apparent to and understood by those skilled in the art from the following detailed description and drawings.

BRIEF DESCRIPTION OF THE DRAWINGS

Referring now to the several FIGURES in the drawings, wherein like elements are numbered alike in the several FIGURES.

DESCRIPTION OF THE PREFERRED EMBODIMENT

Figure 1:
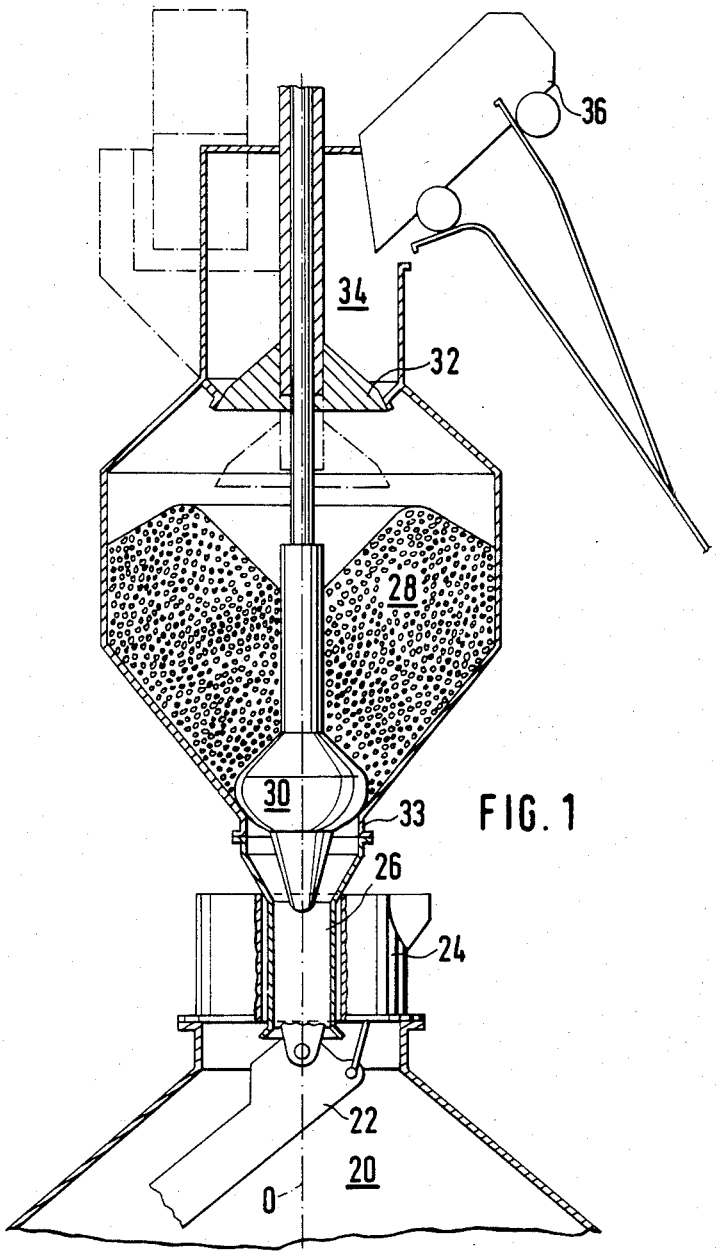
FIG. 1 is a sectional longitudinal or elevational view through a first embodiment of the feeding device of the present invention showing one configuration of the upper closing mechanism.
Figure 2:
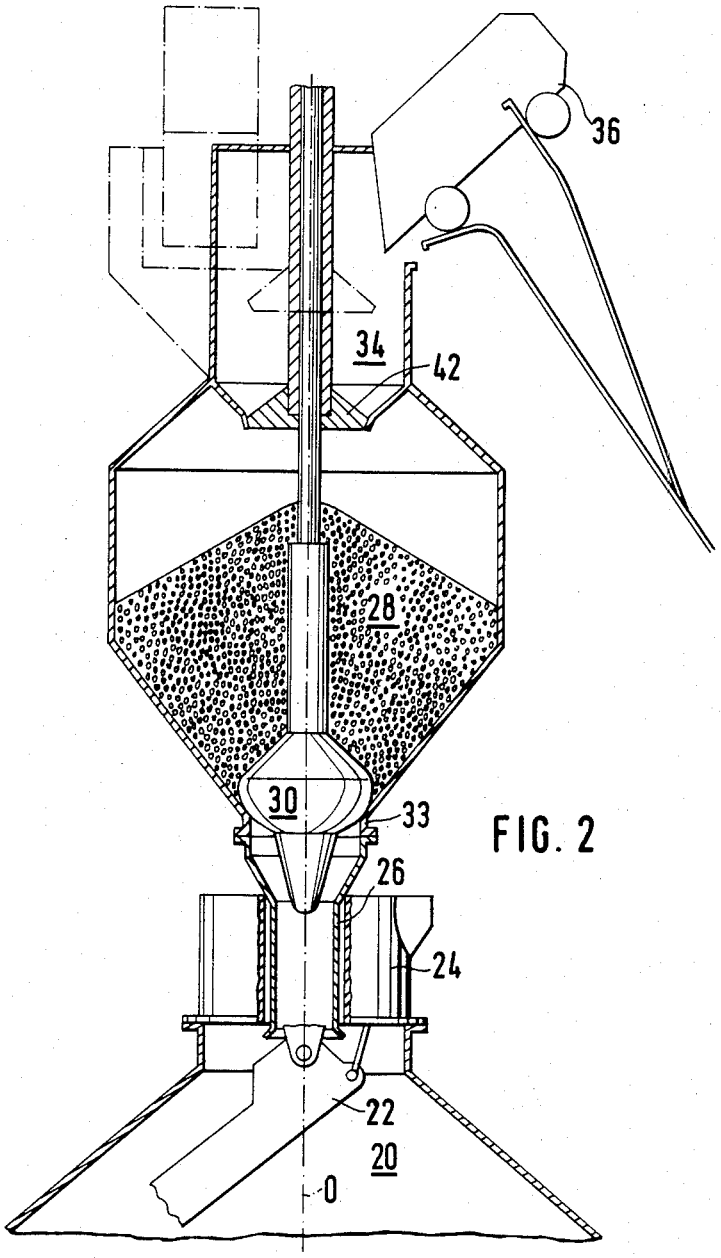
FIG. 2 is a view similar to FIG. 1 showing another configuration of the upper closing mechanism.

Referring jointly to FIGS. 1 and 2, a shaft furnace feeding device of the present invention is shown wherein a rotary or oscillating spout 22 is suspended for the distribution of the charge poured into the furnace 20.

This spout 22 is actuated by a suitable mechanism, which in the illustrated embodiment is located in an enclosure 24, and whose purpose is to impart the desired movement to the spout 22. A vertical central channel 26, on the furnace axis 0, guides the charge to the spout 22.

A storage enclosure or chamber 28, designed as a chamber and provided for this purpose with a lower closing or dosing device 30 and with an upper closing device 32, is mounted above the furnace 20. The lower closing device 30 also serves to regulate the flow of the material from the chamber 28 into the channel 26. Chamber 28 has a discharge pipe or channel 33 leading to channel 26.

In a preferred embodiment of the present invention, the chamber 28 is mounted symmetrically around the central axis 0 of the furnace, as are the discharge pipe 33 and the dosing device 30. During operation, the material to be fed to the furnace falls directly from the chamber 28 symmetrically in respect to the axis 0 onto the spout 22. The material is therefore always discharged from the chamber 28 in the same manner, thus eliminating any problems connected with non-symmetrical distribution caused by oblique and non-concentric discharge of the material.

The dosing operation, i.e., the control of the position of the dosing device 30 for the purpose of regulating the rate of flow, is effected in accordance with the furnace charging requirements and in accordance with the amount of material present in the chamber 28.

The weighing operation is performed by means of a number of balances, preferably three ( not shown in the drawing), the chamber resting on these balances which in their turn are supported by fixed uprights forming part of the framework or superstructure of the furnace.

Above the chamber 28 is a stand-by hopper 34, designed to be filled, for example, by means of skips 36, while the chamber 28 is being emptied. The closing and holding device 32 provided at the base of this hopper 34 is movable between a closed position and an open position to selectively stop or permit flow communication of charging material between the hopper 34 and the chamber 28. To enable the charging material to be transferred as rapidly as possible from the stand-by hopper 34 to the chamber 28, the cross section of the closing device 32 is preferably made as large as possible.

The various phases constituting a charging cycle and the relationship therebetween are explained in detail in French Patent application No. 79 29853, wherein is described a charging mechanism with a single chamber located concentric in respect to the central axis and with a stand-by hopper mounted thereon.

The two embodiments of the invention shown in FIGS. 1 and 2 differ in the layout and operation of their respective upper closing devices 32 and 42. The closing devices are in both cases constructed as a bell-shaped unit and serve to shut off flow from hopper 34 to chamber 28 and thereby enable hopper 34 to retain the required material.

In the embodiment shown in FIG. 1, the closure device 32 operates in the chamber 28 whereas in the embodiment shown in FIG. 2, the upper closing device 42 operates inside the hopper 34. Both illustrations show the closed position in full lines and the open position in dot-and-dash lines. As shown in FIG. 1, the closing device 32 distributes material within the chamber 28 as indicated by the M-shaped charging profile. In FIG. 2 the device 42 is raised for the purpose of opening it. Since this opening operation has to be performed in opposition to the effect of the weight of the material in the hopper 34, the handling of the device 42 consumes more energy than that of the device 32. In the embodiment shown in FIG. 2, the material falls centrally into the chamber 28 with a natural "pouring cone" around the axis 0.

Figure 4:
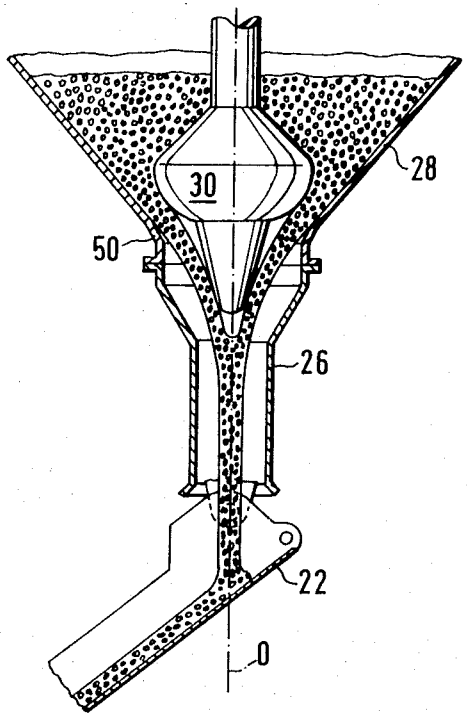
FIG. 4 is a partial sectional view similar to FIG. 3 showing the dosing device in a partially open position.
Figure 3:
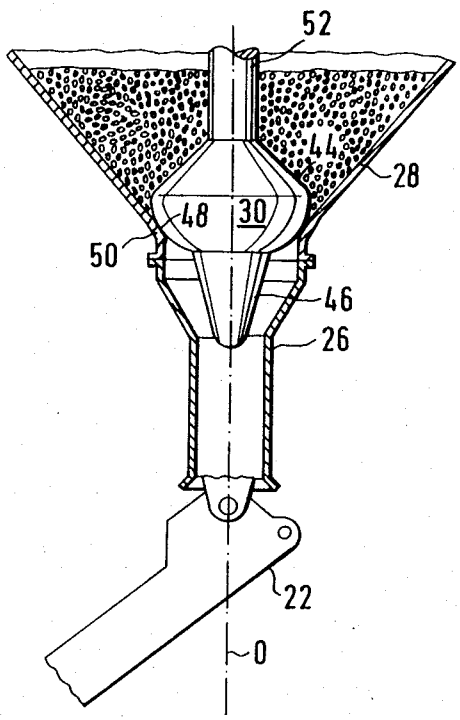
FIG. 3 is a partial sectional view of the dosing device of FIGS. 1 and 2 in a closed position.

The lower closing or dosing device 30 will now be described in greater detail by joint reference to FIGS. 3–5. This closing device is pear-shaped and comprises a widened or bulbous upper portion 44, of which the cross section is wider than that of the discharge pipe 33 of the chamber 28, and a conical or frustoconical lower segment 46 which extends into the channel 26 when the lower closing device 30 occupies its closed position.

The edge 48 forming the transition between the upper portion 44 and the point 46 serves as a shoulder and closure means whereby it interacts with a section 50 of the wall of the chamber 28 and its discharge pipe 33. Section 50 forms a transition segment between the wall of chamber 28 and discharge pipe 33. Section 50 has an angle of inclination intermediate between that of the wall of the chamber 28 and that of the wall of the pipe 33 (see in particular FIGS. 4 and 5). Thus, the section 50 acts as a seat for the closing device 30 for the purpose of ensuring hermeticity. Also, because of the transition angle differences, section 50 is protected from the current of charging material sliding along the slanting wall of the chamber 28 and therefore undergoes no frictional or excessive wear as a result of the flowing feed material.

By the aid of a control bar 52 axially traversing the chamber 28, the upper closing device 32 or 42 and the stand-by hopper 34 are connected to a suitable driving device on the outside of the furnace. This driving device allows the dosing device 30 to be lifted off its seating, in order to establish communication between the chamber 28 and the channel 26 and thereby enable charging material to flow from the chamber 28 to the spout 22.

Figure 5:
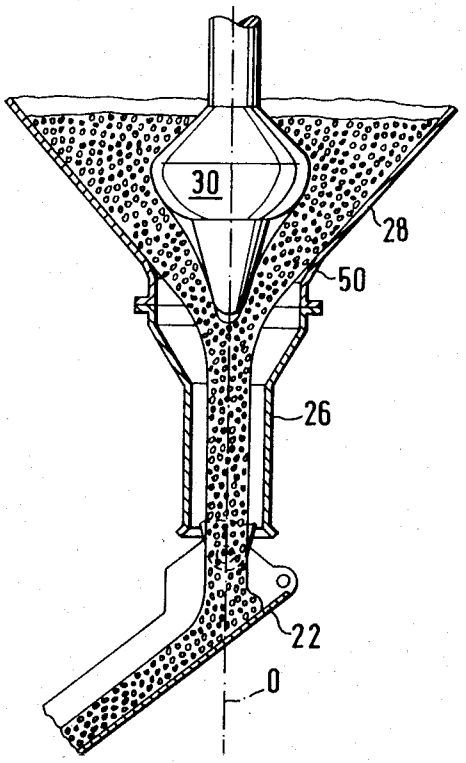
FIG. 5 is a partial sectional view similar to FIG. 3 showing the dosing device in a fully open position.

In FIG. 5 the dosing device 30 has been completely raised enabling a maximum flow to take place from the chamber 28 to the channel 26. FIG. 4 illustrates a partially open position. The particular frustoconical shape of the segment 46 enables material to be acurately and gradually proportioned between the closed position shown in FIG. 3 and the maximum feed rendered possible by the position shown in FIG. 5. In all the open positions, the material falls through the center of the channel 26, along the axis 0 (as illustrated in FIGS. 4 and 5), so that its impact on the spout 22 is in all cases the same, regardless of the spout position or the rate of delivery.

Figure 8:
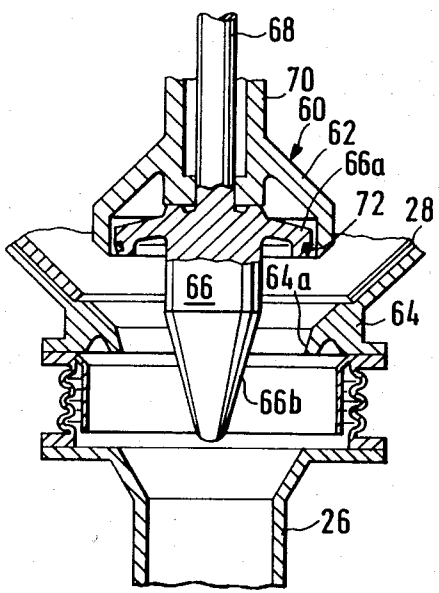
FIG. 8 is a partial sectional view similar to FIG. 6 showing the dosing device in an open position.
Figure 7:
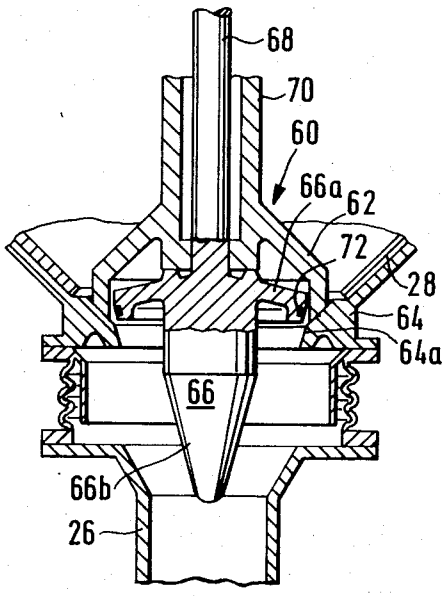
FIG. 7 is a partial sectional view similar to FIG. 6 showing the dosing device in another position.
Figure 6:
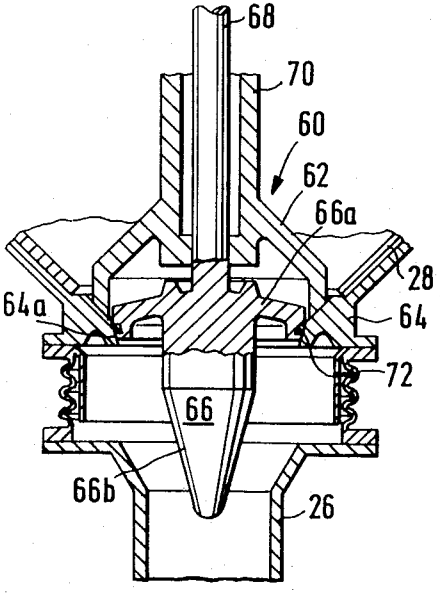
FIG. 6 is a partial sectional view of a second embodiment of the feeding device of the present invention showing the dosing device in a closed position.

In FIGS. 6–8, a second embodiment of the present invention having a different lower closing device 60 is shown. This embodiment is characterized by the functional separation of ensuring tightness on the one hand, and the function of closure and proportioning, on the other. This device 60 comprises an upper bell 62 having an annular lower bevelled edge which, in its closed position (FIGS. 6 and 7), rests on a seat 64 which forms both part of the wall of the chamber 28 as well as the discharge orifice. A lower bell element 66 is shown taking the form of a bell or mushroom-shaped structure and is independent of the upper bell 62. This lower element 66 consists of a plate 66*a*, wherein the edge engages the seat 64 in order to ensure hermeticity, and a conical or frustoconical segment 66*b*, having the same shape and functions as the segment 46 in the embodiment of FIGS. 1 and 2. The upper and lower bell elements 62 and 66 are centrally positioned on and symmetric about the furnace axis.

The lower element 66 is attached to an axial control bar 68, actuated externally, by means of, for example, a hydraulic jack. The bell 62 has a hollow socket 70 coaxially surrounding the lower part of the control bar 68.

The operations of opening and closing the bell 62 are effected by the vertical movement of the element 66, and are sequentially shown in FIGS. 6, 7 and 8. In FIG. 6, the plate 66*a* is hermetically closed on seat 64, while the bell 62 likewise closes on seat 64 and retains the material with which the furnace is to be charged. Plate 66*a* is spaced from a socket 70 on the central section of bell 62. In FIG. 7, the bell 62 occupies the same closed position while the element 66 has been slightly raised inside the bell 62 whereby hermeticity between the chamber 28 and the channel 26 is no longer ensured. If the control bar 68 is raised still further from the position shown in FIG. 7, the plate 66*a* engages the socket 70 and raises the bell 62 from the seat 64 thereby opening the discharge orifice and enabling the material to slide into the channel 26 (FIG. 8). The proportioning operation of flow is effected by varying the amplitude of movement of the control bar 68, which varies the width of the annular discharge orifice between the wall of the chamber 28, on one side, and the edge of the bell 62 and the frustoconical element 66, on the other. The closing operation obviously comprises the same phases as described above but in the reverse order.

As shown in FIGS. 6–8, the edge of the plate 66*a*, which interacts with the seat 64 in order to ensure hermeticity, is permanently protected from contact with the material to be fed to the furnace by being enclosed within a skirt depending from bell 62. Thus, in the course of the movement between the two positions illustrated in FIGS. 7 and 8, the plate 66*a* is at all times protected by the bell 62, whereas during the movement between the positions shown in FIGS. 6 and 7, the bell 62 rests on its seat 64 and prevents the flow of material. It is thus possible for a tight joint 72 of soft material to be provided on the edge of the plate 66*a*.

As in the embodiment of FIGS. 1 and 2, edge 64*a* of the seat 64 which is designed to interact with the tight joint 72 is inclined at a greater angle than the remainder of the seat 64, in order to ensure protection from the charge material when it slides into the channel 26.

In order to increase the mechanical strength of the respective closing devices 30 and 60, conduits may be provided within the closing devices for the circulation of a cooling fluid, which can be supplied via the control bars 52 or 68. Electrical resistance for heating the surfaces of the tight joints may also be used to protect the joints from becoming fooled by damp deposits.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A feeding device for a shaft furnace comprising:

a storage chamber having upper and lower ends;

a feed channel at the lower end of said storage chamber, said feed channel having a vertical axis and having upper and lower ends;

rotatable distribution means at the lower end of said feed channel;

dosing means at the lower end of said storage chamber, said dosing means being symmetrically mounted about said vertical axis, said dosing means being variable between a closed position in which it is in sealing engagement with seat means on said storage chamber to prevent flow of material from said storage chamber and said feed channel, and a plurality of adjustable open positions for controlling flow of material from said storage chamber to said feed channel;

said dosing means including a conical element converging downwardly toward said vertical feed channel, wherein said dosing means defining a variable annular discharge orifice as said dosing means moves between said closed and open positions to establish and vary a vertical flow of charging material along said vertical axis of said feed channel; and means for moving said dosing means between said closed and open positions.

2. The feeding device of claim 1 wherein:

said lower portion of said chamber has a funnel shape.

3. The feeding device of claim 2 wherein:

the angle of inclination of said storage chamber below said seat means is greater than the angle of inclination of said funnel.

4. The feeding device of claim 1 wherein:

said storage chamber is symmetrically mounted about the central axis of said vertical feed channel.

5. The feeding device of claim 1 wherein:

said dosing device has a substantially circular cross section.

6. The feeding device of claim 1 wherein:

said dosing device is pear shaped;

said pear shape containing an upper bulbous portion having a greater width than a lower portion;

said pear shape having an intermediate portion; and said intermediate portion having a shoulder which sealing cooperates with said seat means thereby regulating flow.

7. The feeding device of claim 6 wherein:

said lower portion is said conical element which is downwardly directed toward said vertical feed channel.

8. The feeding device of claim 7 wherein:

said lower portion is frustoconical.

9. The feeding device of claim 8 wherein:

said dosing device is integrally connected to said moving means.

10. The feeding device of claim 9 wherein:

said moving means is a control bar.

11. The feeding device of claim 1 including:

hopper means at the upper end of said storage chamber; and means for opening and closing said hopper means to communication with said storage chamber.

12. The feeding device of claim 11 wherein:

said lower portion of said chamber has a funnel shape.

13. The feeding device of claim 12 wherein:

the angle of inclination of said storage chamber below said seat means is greater than the angle of inclination of said funnel.

14. The feeding device of claim 11 wherein:

said storage chamber is symmetrically mounted about the central axis of said vertical feed channel.

15. The feeding device of claim 11 wherein:

said dosing device has a substantially circular cross section.

16. The feeding device of claim 11 wherein:

said dosing device is pear shaped;

said pear shape containing an upper bulbous portion having a greater width than a lower portion;

said pear shape having an intermediate portion; and said intermediate portion having a shoulder which sealing cooperates with said seat means thereby regulating flow.

17. The feeding device of claim 16 wherein:

said lower portion is said conical element which is downwardly directed toward said vertical feed channel.

18. The feeding device of claim 17 wherein:

said lower portion is frustoconical.

19. The feeding device of claim 18 wherein:

said dosing device is integrally connected to said moving means.

20. The feeding device of claim 19 wherein:

said moving means is a control bar.

21. The feeding device of claim 1 wherein said dosing means includes:

first bell means;

said first bell means containing a lower edge which communicates with the wall of said storage chamber to thereby regulate flow; and said dosing device having second bell means which communicates with said feed channel.

22. The feeding device of claim 21 wherein:

said second bell means is integrally connected to a control bar; and said control bar is longitudinally connected at one end to said first bell means.

23. The feeding device of claim 22 wherein said first bell means includes:

a hollow axial passage traversed by said control bar; and said axial passage having a shoulder wherein said first bell means may be supported thereby.

24. The feeding device of claim 21 including:

a tight joint of soft material along a sealing edge of said second bell means.

* * * * *